US006047687A

United States Patent [19]

Ishikawa et al.

[11] Patent Number: 6,047,687

[45] Date of Patent: Apr. 11, 2000

[54] CANISTER

[75] Inventors: Takashi Ishikawa, Okazaki; Yoshihiko Hyodo, Gotenba; Hideo Yamada, Obu, all of Japan

[73] Assignee: Toyota Jidosha Kabushiki Kaisha, Toyota, Japan

[21] Appl. No.: 09/083,380

[22] Filed: May 22, 1998

[30] Foreign Application Priority Data

May 27, 1997 [JP] Japan ..... 9-136783

[51] Int. Cl.[7] ..... F02M 37/04

[52] U.S. Cl. ..... 123/518; 123/519; 123/520

[58] Field of Search ..... 123/516, 518, 123/519, 520

[56] References Cited

U.S. PATENT DOCUMENTS

| | | | |
|---|---|---|---|
| 5,355,861 | 10/1994 | Arai | 123/519 |
| 5,623,911 | 4/1997 | Kiyomiya et al. | 123/520 |
| 5,632,251 | 5/1997 | Ishikawa | 123/520 |
| 5,632,808 | 5/1997 | Hara et al. | 123/519 |
| 5,642,720 | 7/1997 | Kin | 123/518 |
| 5,653,211 | 8/1997 | Ishikawa | 123/519 |
| 5,743,943 | 4/1998 | Maeda et al. | 123/519 |
| 5,910,637 | 6/1999 | Meiller et al. | 123/519 |
| 5,915,364 | 6/1999 | Katou | 123/519 |
| 5,924,410 | 7/1999 | Dumas et al. | 123/519 |

FOREIGN PATENT DOCUMENTS

| | | |
|---|---|---|
| 7-293364 | 11/1995 | Japan . |
| 7-332171 | 12/1995 | Japan . |
| 9-203353 | 8/1997 | Japan . |
| 9-209849 | 8/1997 | Japan . |

*Primary Examiner*—Thomas N. Moulis
*Attorney, Agent, or Firm*—Kenyon & Kenyon

[57] ABSTRACT

A canister for treating fuel vapor generated in a fuel tank and for supplying fuel vapor to an intake system of an engine via a purge passage. First and second adsorbent compartments are defined in a casing by a partition for accommodating adsorbents. First and second dispersion compartments are defined in the casing for dispersing fuel vapor from the fuel tank. The first and the second dispersion compartments are located at one end of the first and second adsorbent compartments, respectively. A valve device is positioned at one side of the second adsorbent compartment for selectively opening and closing in accordance with the difference between internal and external pressures of the casing. A tank valve is connected to one side of the casing corresponding to the first adsorbent compartment for adjusting the pressure in the fuel tank. An external dispersion compartment is connected to a wall of the casing to communicate with the first dispersion compartment. A breather passage is connected to the external dispersion compartment for introducing fuel vapor into the canister from the fuel tank during refueling, and the external dispersion compartment has a cross sectional area larger than that of the breather passage.

14 Claims, 7 Drawing Sheets

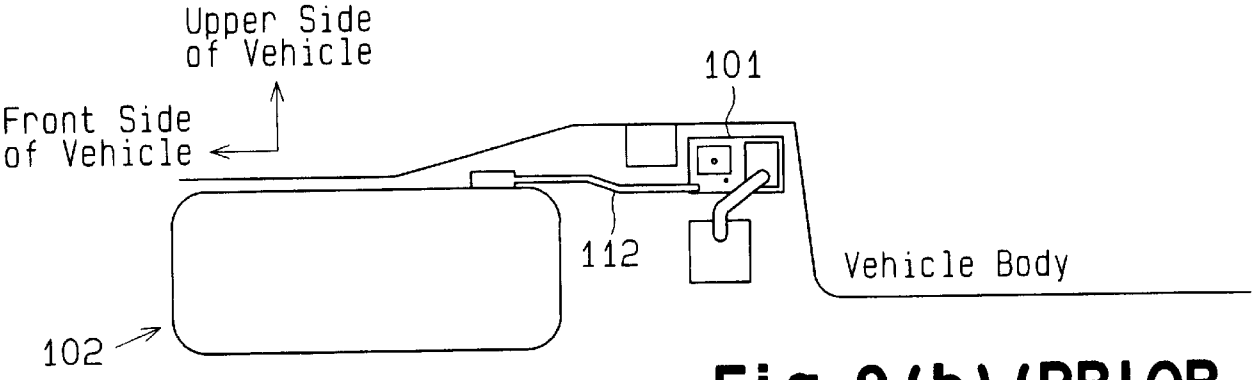
Fig. 9 (a) (PRIOR ART)
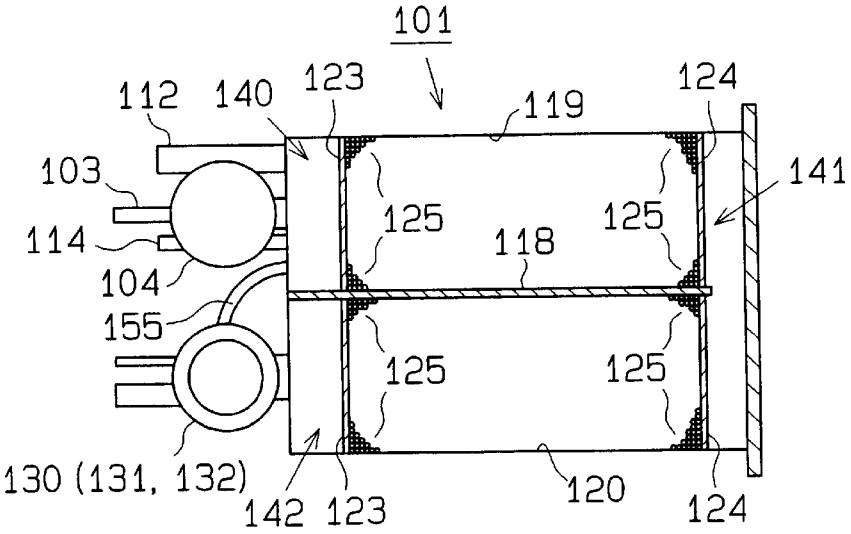
Fig. 9 (b) (PRIOR ART)
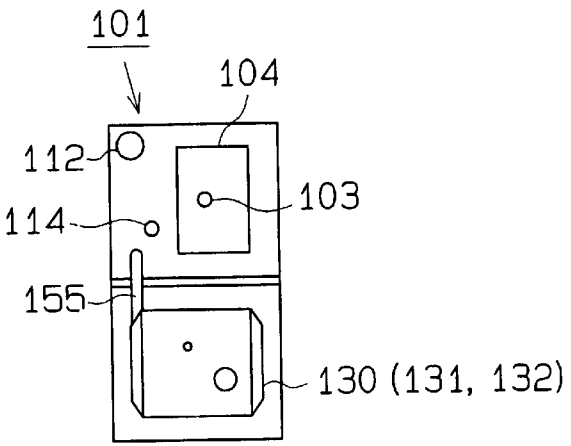
Fig. 9 (c) (PRIOR ART)

CANISTER

BACKGROUND OF THE INVENTION

The present invention relates to canisters that prevent fuel vapor from leaking out of fuel tanks.

Canisters are used to prevent vaporized fuel (fuel vapor) from leaking out of fuel tanks into the atmosphere. A typical canister has a container filled with an adsorbent such as activated carbon to collect vapor. The container includes a vapor passage, a purging passage, and an air passage. Fuel vapor is drawn into the canister through the vapor passage. The fuel vapor is then purged toward an engine intake manifold through the purging passage. The air passage is used to draw atmospheric air into the canister or to release the air in the canister into the atmosphere. The adsorbent temporarily collects the fuel vapor drawn into the container from the fuel tank. The collected fuel is then separated from the adsorbent by the negative pressure, or vacuum pressure, produced during the operation of the engine and drawn into the purging passage toward the engine intake system (i.e., surge tank). Subsequently, the vapor drawn into the intake system is mixed with ambient air and sent to combustion chambers of the engine.

Fuel vapor also leaks out of fuel tank filler necks into the atmosphere during refueling. It is known that such fuel vapor is one factor that causes air pollution. Japanese Unexamined Patent Publication No. 8-210530 describes a canister having an onboard refueling vapor recovery function (ORVR) for solving this problem. The ORVR instantaneously collects a large amount of the vapor produced in a fuel tank during refueling. A breather passage is provided between the canister and the fuel tank in addition to the purge passage. The diameter of the breather passage is greater than that of the purge passage. The large amount of fuel vapor produced during refueling is collected in the canister by way of the breather passage. The canister incorporating the OCRV function collects the vapor in the fuel tank without leakage of the fuel vapor.

A canister having an ORVR function and located in the vicinity of an automobile fuel tank is shown in FIGS. 9(*a*), 9(*b*), and 9(*c*). As shown in the drawings, a box-like canister 101 includes a tank valve 104, which is located on a side wall of the canister 101 (left wall as shown in FIG. 9(*b*)), a tank port 103, a breather passage 112, a purge passage 114, and an atmospheric valve 130.

The canister 101 contains an adsorbent (activated carbon pellets) 125 for temporarily adsorbing fuel vapor. As shown in FIG. 9(*b*), a partition 118 separates the adsorbent 125 into two sections. The two sections of the adsorbent 125 are held between filters 123, 124. The partition 118 and the filters 123, 124 define first and second adsorbent compartments 119, 120 in the canister 101, while dispersion compartments 140, 141, 142 are defined at the ends of the adsorbent compartments 119, 120. The dispersion compartments 140, 141 function to disperse the fuel vapor moving through the canister 101 in a uniform manner such that localized concentration of the vapor does not take place.

The tank valve 104, the tank port 103, the breather passage 112, and the purge passage 114 are employed to adjust the pressure in a fuel tank 102 and are connected to the dispersion compartment 140, which communicates with the first adsorbent compartment 119 through the filter 123. The atmospheric valve 130 is connected with the dispersion compartment 142, which communicates with the second adsorbent compartment 120. The first and second adsorbent compartments 119, 120 communicate with each other through the filter 124 and the dispersion compartment 141.

The fuel vapor produced in the fuel tank 102 is normally drawn into the dispersion compartment 140 by way of the tank port 103 and the tank valve 104. When refueling the fuel tank 102, fuel vapor is drawn into the dispersion compartment 140 mainly through the breather passage 112. The fuel vapor drawn into the canister 101 passes through the filter 123 to be collected by the activated carbon in the first and second adsorbent compartments 119, 120.

When purging the fuel vapor, the negative pressure, or vacuum pressure, produced in the engine intake manifold (not shown) separates the fuel vapor from the activated carbon and draws the vapor into the intake manifold through the purge passage 114. The atmospheric valve 130 is a diaphragm type valve and has a relief port 131 for releasing the air in the canister 101 into the atmosphere and an intake port 132 for drawing the air into the canister 101. The intake port 132 is connected with an intake passage 155. When purging the fuel vapor in the canister 101, the low pressure, or negative pressure, in the dispersion compartment 140 is communicated to the intake port 132 thereby opening the intake port 132.

For immediate and efficient adsorption of a large amount of vapor during the employment of the ORVR function, it is preferable that the fuel vapor be uniformly dispersed when reaching the adsorbent 125. In the prior art canister 101, fuel vapor is dispersed to a certain degree in the dispersion compartment 140 to enhance the adsorbing rate of the fuel vapor by the activated carbon.

A large amount of fuel vapor having a high velocity is sent from the fuel tank 102 into the canister 101 through the breather passage 112. Furthermore, the diameter of the breather passage 112 is normally larger than that of the purge passage 114 and other passages to reduce the air flow resistance. Therefore, the breather passage 112 cannot be arranged freely. More specifically, the arrangement of the breather passage 112 in the prior art is limited to the end portion of the canister side wall.

Accordingly, it is difficult to obtain the desirable dispersion effects with the dispersion compartment 140. To solve this problem, the volume of the dispersion compartment 140 may be increased. However, this would enlarge the canister. A larger canister takes up valuable space in the automobile.

SUMMARY OF THE INVENTION

Accordingly, it is an objective of the present invention to provide a canister that efficiently processes the large amount of fuel vapor produced in the fuel tank and that can be easily installed in an automobile.

To achieve the above objective, the present invention provides a canister for treating fuel vapor generated in a fuel tank and for supplying fuel vapor to an intake system of an engine via a purge passage, the canister comprising: a casing; an adsorbent compartment defined in the casing for accommodating adsorbent; an internal dispersion compartment defined in the casing for dispersing fuel vapor introduced from the fuel tank; an external dispersion compartment connected to a wall of the casing to communicate with the internal dispersion compartment; and a breather passage connected to the external dispersion compartment for introducing fuel vapor into the canister from the fuel tank during refueling, wherein the external compartment has a cross sectional area larger than that of the breather passage.

The present invention further provides a canister for treating fuel vapor generated in a fuel tank and for supplying fuel vapor to an intake system of an engine via a purge passage, the canister comprising: a casing; a first adsorbent compartment defined in the casing by a partition for accommodating adsorbent; a second adsorbent compartment defined in the casing by the partition for accommodating adsorbent; a first dispersion compartment defined in the casing, the first dispersion compartment being located at one end of the first adsorbent compartment, for dispersing fuel vapor from the fuel tank; a second dispersion compartment defined in the casing, the second dispersion compartment being located at one end of the second adsorbent compartment, for dispersing fuel vapor from the fuel tank; a valve device positioned at one side of the second adsorbent compartment for selectively opening and closing in accordance with the difference between internal and external pressures of the casing; a tank valve connected to one side of the casing, that is corresponding to the first adsorbent compartment, for adjusting the pressure in the fuel tank; an external dispersion compartment connected to a wall of the casing to communicate with the first dispersion compartment; and a breather passage connected to the external dispersion compartment for introducing fuel vapor into the canister from the fuel tank during refueling, wherein the external dispersion compartment has a cross sectional area larger than that of the breather passage.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 9(*a*) is a schematic view showing a fuel tank and a prior art canister arranged at the rear lower section of an automobile;

FIG. 9(*b*) is an upper partial cross-sectional view showing the canister of FIG. 9(*a*); and FIG. 9(*c*) is a side view showing the canister of FIG. 9(*a*) and FIG. 9(*b*).

DETAILED DESCRIPTION OF THE PREFERRED EMBODIMENTS

A preferred embodiment of a canister according to the present invention will now be described with reference to FIGS. 1 to 6. The processing of fuel vapor produced in a fuel tank during refueling and drawn into a canister to collect fuel components will hereafter be referred to as ORVR processing. The processing of fuel vapor performed at other times (ordinary conditions) will hereafter be referred to as normal vapor processing.

Figure 1:
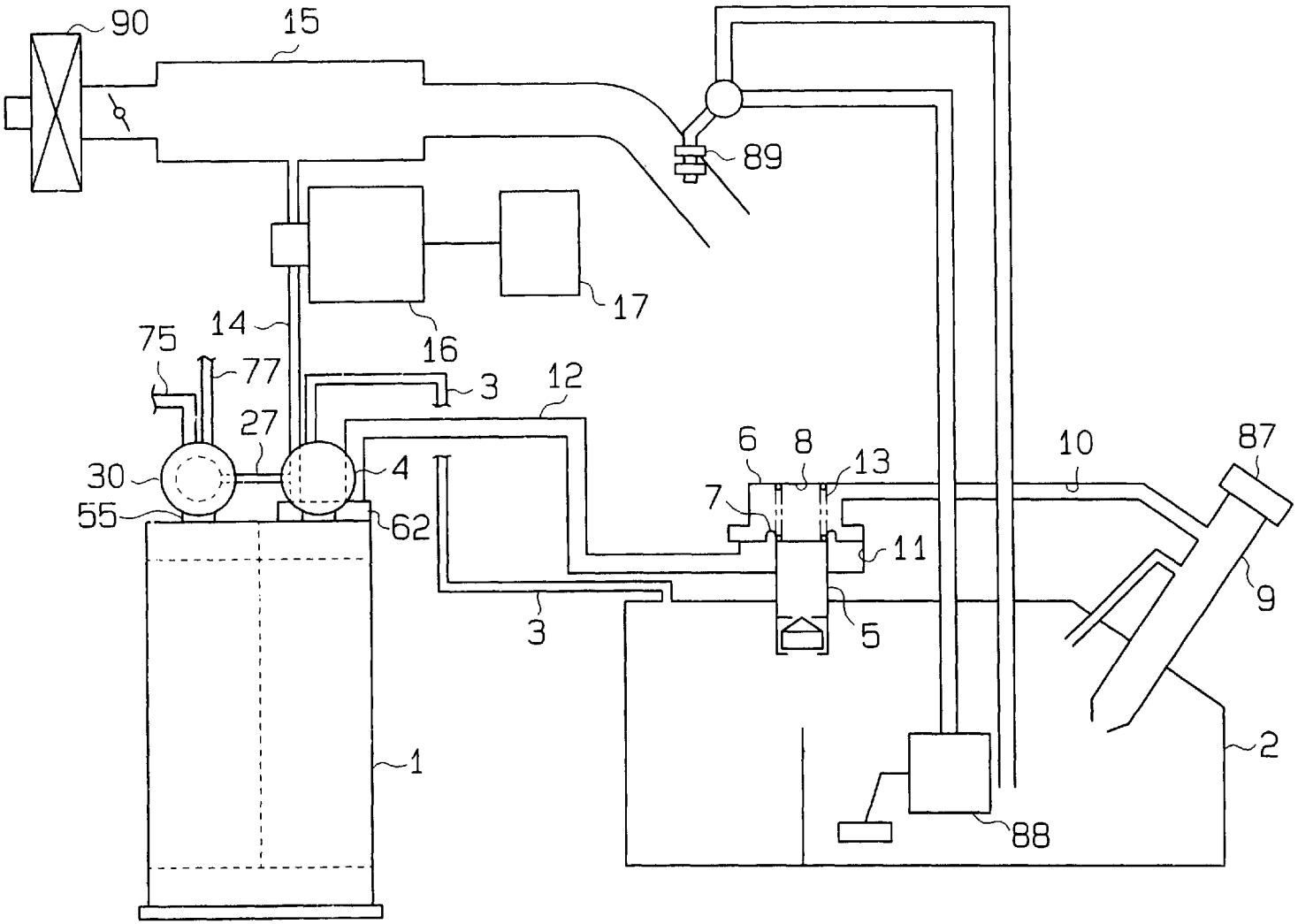
FIG. 1 is a schematic view showing a fuel vapor processing system installed in an automobile that employs a canister according to the present invention.

As shown in FIG. 1, a canister 1 is connected to a fuel tank 2 by a vapor passage 3. The fuel vapor produced in the fuel tank 2 is drawn into the canister 1 through the vapor passage 3. A tank valve 4 is provided on the canister 1 to connect the vapor passage 3 to the canister 1. The fuel vapor in the fuel tank 2 is drawn into the canister 1 when the pressure in the tank 2 exceeds a predetermined pressure and opens the tank valve 4. The tank valve 4 is a diaphragm type valve.

A breather pipe 5 extends from the top of the fuel tank 2. A differential pressure valve 6 covering the upper end of the breather pipe 5 is opened when refueling the fuel tank 2. Like the tank valve 4, the differential pressure valve 6 is a diaphragm type valve. A diaphragm 7 divides the interior of the pressure valve 6 into a first pressure chamber 8 and a second pressure chamber 11. A pressure passage 10 connects the first pressure chamber 8 to a fuel filler pipe 9 extending from the fuel tank 2. A breather passage 12 connects the second pressure chamber 11 to the canister 1. The first pressure chamber 8 includes a coil spring 13 that urges the diaphragm 7 downward to close the upper opening of the breather pipe 5.

When refueling the fuel tank 2, the fuel vapor produced in the fuel tank 2 is drawn into the canister 1 through the breather passage 12. The amount of fuel vapor passing through the breather passage 12 during ORVR processing is much greater than that during normal vapor processing (ten to one hundred times greater). Thus, the breather passage 12 has a cross-sectional area that is about ten times larger than that of the vapor passage 3.

The canister 1 is connected to a surge tank 15, which is part of the engine intake system, by a purge passage 14. A purge valve 16 is arranged in the purge passage 14 to control the amount of fuel vapor purged toward the surge tank 15. The purge valve 16 is opened and closed in correspondence with signals sent from an electronic control unit (ECU) 17.

Figure 2:
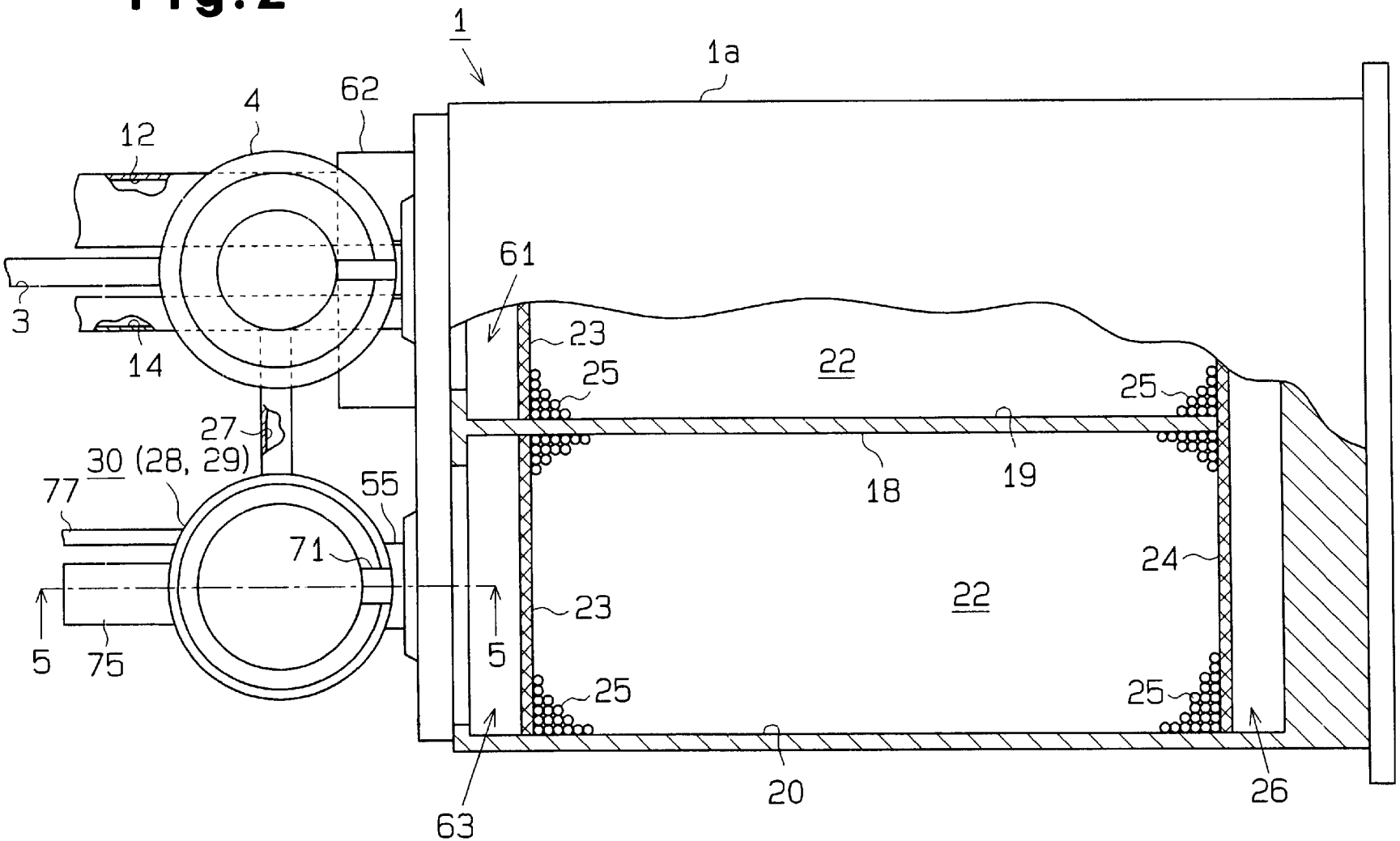
FIG. 2 is a partial cross-sectional view showing the canister of FIG. 1.
Figure 3:
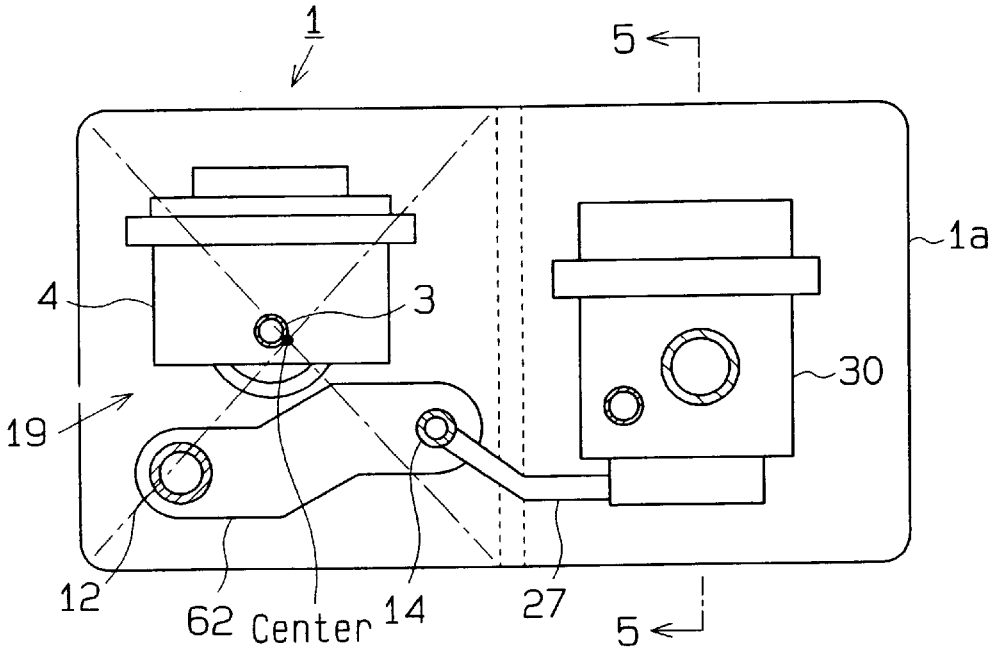
FIG. 3 is a side view showing the canister.

As shown in FIGS. 2 and 3, the canister 1 is installed in an automobile in the same manner as the prior art canister shown in FIG. 9. The canister 1 is a side flow type canister in which fuel vapor flow horizontally.

As shown in FIG. 2, the canister 1 has a casing 1*a*. A partition 18 separates the interior of the casing 1*a* into first and second adsorbent (activated carbon) compartments 19, 20. A filter 23 defines a dispersion compartment 61 at the upstream end of the first adsorbent compartment 19 and another dispersion compartment 63 at the downstream end of the adsorbent compartment 20. A filter 24 defines an internal dispersion compartment 26 at the downstream end of the first adsorbent compartment 19 and the upstream end of the second adsorbent compartment 20. The adsorbent compartments 19, 20 communicate with each other through the dispersion compartment 26. The space between the filters 23, 24 contains pellet-like adsorbents, or activated carbon pellets 25, for adsorbing fuel vapor. The activated carbon pellets 25 in each adsorbent compartment 19, 20 define an activated carbon layer 22. The adsorbent is not limited to activated carbon as long as toxic substances, such as hydrocarbons, can be separably adsorbed by the adsorbent.

Figure 4:
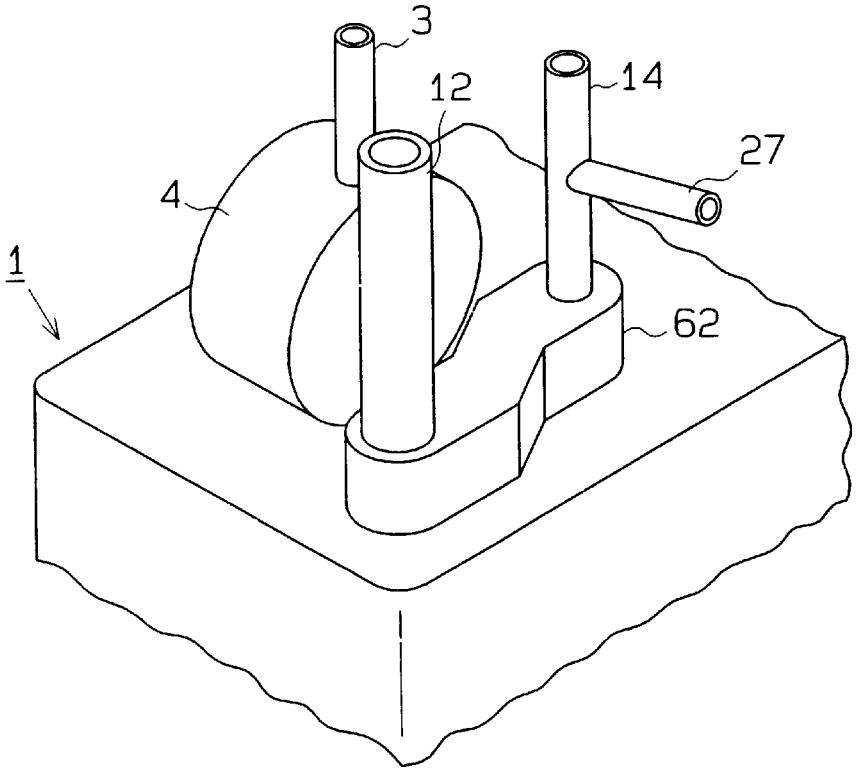
FIG. 4 is a perspective view showing the vicinity of an external dispersion compartment arranged at the side of the canister.
Figure 5:
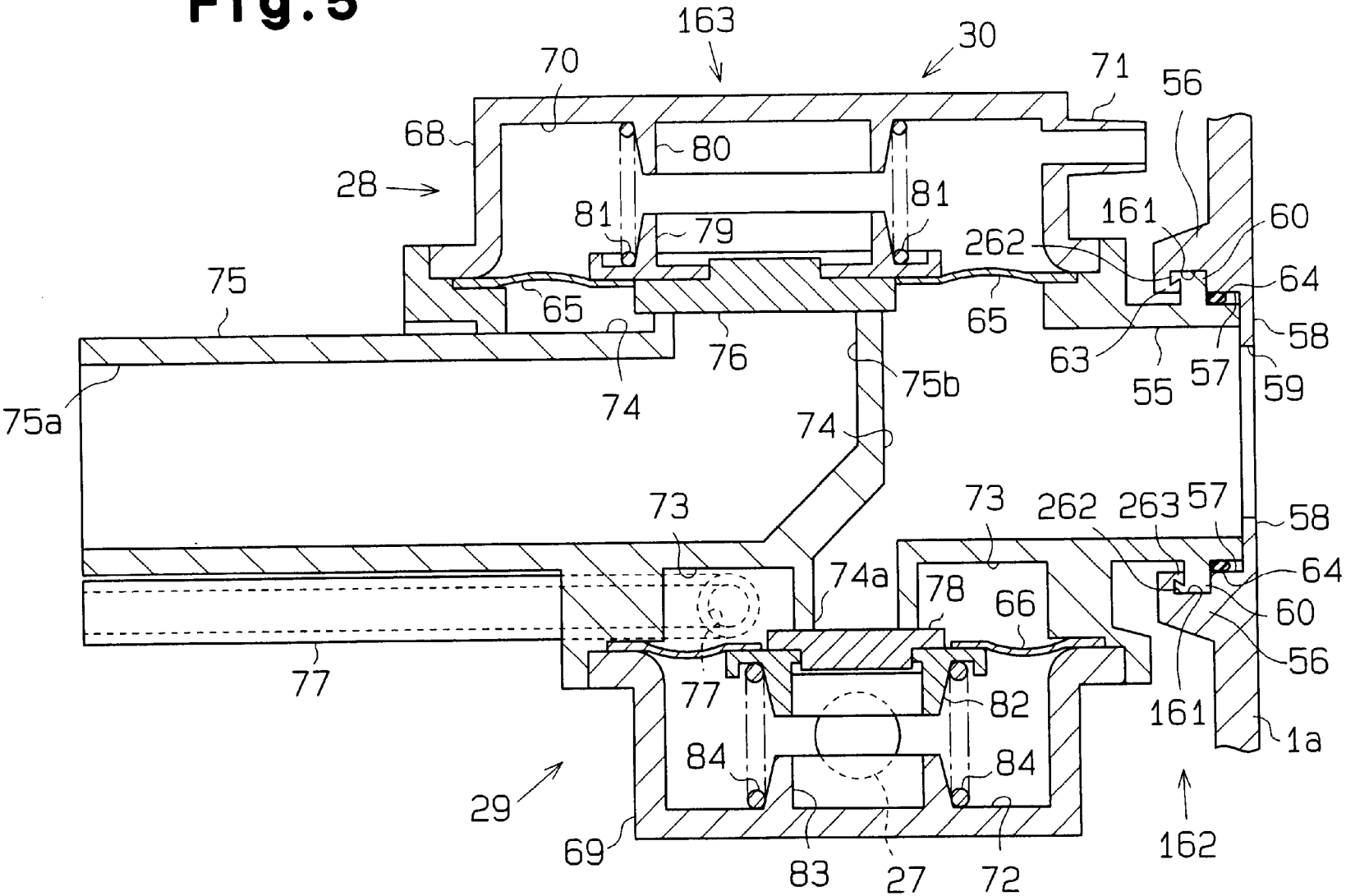
FIG. 5 is a cross-sectional view taken along line 5—5 in FIGS. 2 and 3.

A tank valve 4 and an external dispersion compartment 62 are provided on the left wall of the casing 1*a* next to the first adsorbent compartment 19, as viewed in FIG. 2. There is no interference between the tank valve 4 and the dispersion compartment 62, as shown in FIG. 3. As shown in the enlarged view of FIG. 4, the dispersion compartment 62 has a generally oblong shape and a hollow interior. Furthermore, the external dispersion compartment 62 and the internal dispersion compartment 61 are connected to each other without any obstacles in between. As shown in FIGS. 3 and 4, the breather passage 12 and the purge passage 14 are connected to the dispersion compartment 62. The purge passage 14 is connected to one end of a pressure passage 27. The other end of the pressure passage 27 is connected with a back pressure chamber 72 of an intake valve 29, as shown in FIG. 5. An atmospheric valve device 30 is provided on the wall of the casing 1*a* next to the second adsorbent compartment 20.

As shown in FIG. 5, the atmospheric valve device 30 has a main body including a joint 162 for detachably coupling the atmospheric valve device 30 to the casing 1*a*. The atmospheric valve device 30 includes a pressure pipe 55 through which ambient air is drawn into the canister 1 and through which the fuel vapor collected in the canister 1 is discharged externally.

A ring-like portion 56 projects from the casing 1*a* at the location where the atmospheric valve device 30 is coupled. A space 57 is defined in the ring-like portion 56. A flange 58 extends inward from the ring-like portion 56 adjacent to the second adsorbent compartment 20. The inner surface of the flange 58 defines an atmospheric port 59. A housing 163 and the casing 1*a* are communicated to each other through the atmospheric port 59. An annular rib 60 projecting from the outer surface of the pressure pipe 55 is fitted into a groove 161 extending through the ring-like portion 56. A key 262 extends from the rib 60, while a keyway 263 extends along the groove 161. The key 262 and the keyway 263 engage with each other such that relative movement between the rib 60 and the groove 161 is restricted. An O-ring 64 seals the space between the outer surface of the pressure pipe 55 and the inner surface of the ring-like portion 57.

The atmospheric valve device 30 includes a relief valve 28 and an intake valve 29. The relief valve 28 is located above the intake valve 29. Two diaphragms 65, 66 are arranged in the atmospheric valve device 30. The diaphragms 65, 66 are circular and made of a flexible material. The diaphragm 65, which is associated with the relief valve 28, has a peripheral portion held between the valve device main body and an upper cap 68. A spring receptor 79 and a valve body 76 are mounted on the central portion of the diaphragm 66. The diaphragm 66, which is associated with the intake valve 29, has a peripheral portion held between the main body and a lower cap 69. A spring receptor 82 and a valve body 78 are secured to the central portion of the diaphragm 66.

The diaphragm 65, the valve body 76, and the upper cap 68 define an atmospheric pressure chamber 70 of the relief valve 28. An intake nozzle 71 extends laterally from the upper cap 68 to maintain the pressure in the atmospheric pressure chamber 70 equal to the atmospheric pressure. The diaphragm 66, the valve body 78, and the lower cap 69 define the back pressure chamber 72 in the intake valve 29. As described above, the back pressure chamber 72 is connected to the purge passage 14 through the pressure passage 27 (refer to FIGS. 1 to 4). The diaphragms 65, 66 define a positive pressure chamber 74 commonly used by the intake and relief valves 29, 28. The positive pressure chamber 74 communicates with the second adsorbent compartment 20 through the pressure pipe 55.

The intake valve 29 includes a vertical passage 74*a*. The diaphragm 66, the valve body 78, and the passage 74*a* define an atmospheric pressure chamber 73 in the intake valve 29. An intake pipe 77 is connected to the rear side of the atmospheric pressure chamber 73 to maintain the pressure in the atmospheric pressure chamber 73 equal to the atmospheric pressure. The passage 74*a* is closed by the valve body 78.

A relief pipe 75 extends externally from the atmospheric valve device 30. The relief pipe 75 has an opening 75*a*, which opens to the atmosphere, and an opening 75*b*, which is closed by the valve body 76. The end of the relief pipe 75 defining the opening 75*b* serves as a valve seat of the relief valve 28.

The upper cap 68 has an annular positioner 80 located at a position corresponding to the spring receptor 79. A coil spring 81 is held between the spring receptor 79 and the positioner 80. The force of the coil spring 81 urges the spring receptor 79 downward and closes the opening 75*b* of the relief pipe 75 with the valve body 76. Accordingly, the relief valve 28 is closed when the pressure of the second adsorbent compartment 20, which is communicated to the positive pressure chamber 74, is lower than a first reference value.

The intake valve 29 has an annular positioner 83 located at a position corresponding to the spring receptor 82. A coil spring 84 is held between the spring receptor 82 and the positioner 83. The force of the coil spring 84 urges the spring receptor 82 upward and closes the passage 74*a* of the positive pressure chamber 74 with the intake valve body 78. Accordingly, the intake valve 29 is normally closed. When purging the fuel vapor in the canister 1 toward the engine intake system, the negative pressure (vacuum pressure) produced in the purge passage 14 is communicated to the back pressure chamber 72 through the pressure passage 27. This produces a pressure difference between the back pressure chamber 72 and the atmospheric pressure chamber 73. As a result, ambient air is drawn into the canister 1 through the intake pipe.

The operation of the canister 1 will now be described. With reference to FIG. 1, the fuel vapor in the fuel tank 2 is drawn into the canister 1 during normal vapor processing. More specifically, the vaporization of the liquid fuel in the fuel tank 2 increases the fuel vapor in the fuel tank 2. This increases the pressure in the fuel tank 2 and draws the vapor in the fuel tank 2 into the tank valve 4 through the vapor passage 3. The vapor acts on a diaphragm incorporated in the tank valve 4. When the pressure in the fuel tank 2 exceeds a predetermined value, the tank valve 4 is opened. This permits the fuel vapor to be drawn into the canister 1 through the vapor passage 3 and the tank valve 4. Since the pressure in the first pressure chamber 8 of the differential pressure valve 6 is equal to that in the fuel tank 2, the pressure valve 6 remains closed. Accordingly, the breather passage 12 is closed.

The fuel vapor in the fuel tank 2 is also drawn into the canister 1 during ORVR processing. More specifically, when refueling the fuel tank 2, the filler cap 87 of the fuel filler pipe 9 is opened to insert a fuel pump nozzle (not shown) into the fuel filler pipe 9. Accordingly, the pressure in the fuel filler pipe 9 becomes equal to the atmospheric pressure. Since the first pressure chamber 8 of the differential pressure valve 6 communicates with the interior of the fuel filler pipe 9, the pressure in the first pressure chamber 8 becomes equal to the atmospheric pressure. As the fuel from the pump nozzle fills the fuel tank 2, the surface of the fuel rises and the fuel tank 2 becomes full of fuel vapor. This increases the pressure in the fuel tank 2. The fuel tank pressure is communicated to the breather pipe 5. When the difference between the pressure in the breather pipe 5 and the atmospheric pressure in the first pressure chamber 8 exceeds a predetermined value, the pressure in the breather pipe 5 lifts the diaphragm 7 of the differential pressure valve 6. As a result, the fuel vapor in the fuel tank 2 are drawn into the canister 1 through the breather passage 12. The differential pressure valve 6 is opened at a pressure value that is lower than the pressure value that opens the tank valve 4. Thus, the tank valve 4 is closed during ORVR processing.

As described above, the fuel vapor in the fuel tank 2 is drawn into the canister 1 through the vapor passage 3 during normal vapor processing. During ORVR processing, the fuel vapor are drawn into canister 1 through the breather passage 12.

The processing of fuel vapor inside the canister 1 will now be described with reference to FIGS. 2 to 5. With reference to FIG. 2, the fuel vapor drawn into the canister 1 passes through the dispersion compartment 61 and the filter 23 to be adsorbed by the activated carbon layer 22 in the first adsorbent compartment 19. The fuel components of the fuel vapor are collected by the activated carbon pellets 25, which constitute the activated carbon layer 22. The fuel vapor then passes through the filter 24 and the dispersion compartment 26 and flows into the second adsorbent compartment 20. As the fuel vapor passes through the filter 24 and into the activated carbon layer 22 in the second adsorbent compartment 20, the activated carbon pellets 25, which constitute the activated carbon layer 22, collect the fuel components that were not collected in the first adsorbent compartment 19.

With reference to FIG. 5, the fuel vapor from which most of the fuel components have been collected passes through the filter 23, the dispersion compartment 63, and the atmospheric port 59 to be drawn into the positive pressure chamber 74 of the atmospheric valve device 30. If the amount of fuel vapor drawn into the canister 1 through the vapor passage 3 or the breather passage 12 is small, that is, if the pressure in the canister 1 is relatively low, the relief valve 28 and the intake valve 29 are both maintained in a closed state. Therefore, the air drawn into the positive pressure chamber 74 is not discharged into the atmosphere. When the amount of fuel vapor drawn into the canister 1 increases and the pressure in the canister 1 exceeds the first reference value, the diaphragm 65 in the relief valve 28 is urged upward by the pressure of the positive pressure chamber 74 such that the relief valve 28 is opened. Accordingly, the air drawn into the positive pressure chamber 74 is discharged externally through the relief valve 28 and the relief pipe 75.

The intake valve 29 remains closed even if the relief valve 28 is opened. This is because of the pressure increase in the back pressure chamber 72 that is communicated through the pressure passage 27 regardless of the pressure increase in the positive pressure chamber 74. More specifically, the purge valve 16 is closed when the relief valve 28 is opened, and the positive pressure of the first adsorbent compartment 19 is communicated through the pressure passage 27 into the back pressure chamber 72 of the intake valve 29. This urges the intake valve diaphragm 66 upward as viewed in FIG. 5. Meanwhile, the pressure of the positive pressure chamber 74 is communicated through the passage 74*a* to act on the diaphragm 66. The pressure of the positive pressure chamber 74 also acts on the diaphragm 66. Thus, the diaphragm 66 is urged downward as viewed in FIG. 5. However, the pressure of the positive pressure chamber 74 is equal to the pressure communicated to the back pressure chamber 72. Furthermore, atmospheric pressure is constantly communicated to the positive pressure chamber 74 through the intake pipe 77. Consequently, the valve body 78 secured to the diaphragm 66 is biased toward the passage 74*a*. Accordingly, the air in the positive pressure chamber 74 does not leak out through the intake pipe 77.

The canister 1 gradually collects the fuel components included in the fuel vapor as the vapor passes through the activated carbon layers 22 contained in the first and second adsorbent compartments 19, 20. The fuel vapor produces a generally U-like flow in the canister 1. This increases the moving distance of the fuel vapor in the canister 1. In other words, the time during which the fuel vapor are in contact with the activated carbon pellets 25 is increased. Therefore, the fuel components included in the fuel vapor are collected efficiently.

The delivery of the fuel components, which are collected in the canister 1, to the engine intake system will now be described with reference to FIGS. 1 and 5. When the engine is started, a flow of air used for combustion is produced in the engine intake system. The air flow decreases the pressure near the opening of the purge passage 14 in the surge tank 15. Thus, negative pressure (vacuum pressure) is produced in the purge passage 14. Whenever the ECU 17 opens the purge valve 16, a flow of fuel vapor from the canister 1 toward the surge tank 15 is produced in the purge passage 14. This decreases the pressure in the canister 1.

With reference to FIG. 5, the decreased pressure is communicated to the back pressure chamber 72 of the intake valve 29 through the pressure passage 27 such that the pressure in the pressure chamber 72 becomes lower than a second reference value. The vacuum pressure in the back pressure chamber 72 urges the diaphragm 66 of the intake valve 29 downward and opens the intake valve 29. This draws new air into the atmospheric pressure chamber 73 through the intake pipe 77. The air flows into the second adsorbent compartment 20 of the canister 1 through the passage 74*a,* the positive pressure chamber 74, the pressure pipe 55, and the atmospheric port 59. The air separates and mixes with the fuel components adsorbed in the activated carbon pellets 25. The mixture of air and fuel components (vapor) is drawn into the purge passage 14 through the dispersion compartment 26 and the first adsorbent compartment 19 and sent to the surge tank 15 through the purge valve 16.

The fuel vapor passes through an air cleaner 90 in the surge tank 15 and mixes with the air to be supplied to the engine cylinders. A fuel pump 88 sends the fuel in the fuel tank 2 to fuel injectors 89 associated with the engine cylinders. The fuel is mixed with the fuel vapor and burned in the cylinders.

The operation of the canister 1 during ORVR processing will now be described with reference to FIGS. 1 to 4. When fuel vapor is drawn into the canister 1 through the breather passage 12 during ORVR processing, the fuel vapor first flows into the external dispersion compartment 62, the cross-sectional area of which is greater than that of the breather passage 12. The fuel vapor then enters the internal dispersion compartment 61 to pass through the activated carbon layer 22. A large amount of fuel vapor having a high velocity is sent from the breather passage 12. However, such fuel vapor is dispersed during two stages, first in the external dispersion compartment 62 and then in the internal dispersion compartment 61. The fuel vapor is thus well dispersed before reaching the activated carbon layer 22. Since the fuel vapor reaches the activated carbon layer 22 in a uniformly dispersed state, the fuel vapor is efficiently adsorbed by the activated carbon layers 22.

The canister 1 according to the present invention is provided with an external dispersion compartment 62, which has an appropriate volume and box-like shape and which is located adjacent to the tank valve 4. The compact coupling structure of the external dispersion compartment 62 minimizes the dimensions of the canister 1.

As shown in FIGS. 3 and 4, the external dispersion compartment 62 is arranged near the central portion of the activated carbon layer 22 contained in the first adsorbent compartment 19. Furthermore, the external dispersion compartment 62 extends from the breather passage 12 toward the central portion of the activated carbon layer 22 contained in the first adsorbent compartment 19. This arrangement further improves the dispersion of the fuel vapor that passes through the activated carbon layers 22.

In the same manner as the breather passage 12, the purge passage 14 is also connected with the external dispersion compartment 62. Thus, the fuel vapor leaving the canister 1 is first sent to the external dispersion compartment 62 during purging. This structure enhances the purging efficiency of the fuel vapor sent from the canister to the purge passage 14.

Figure 6:
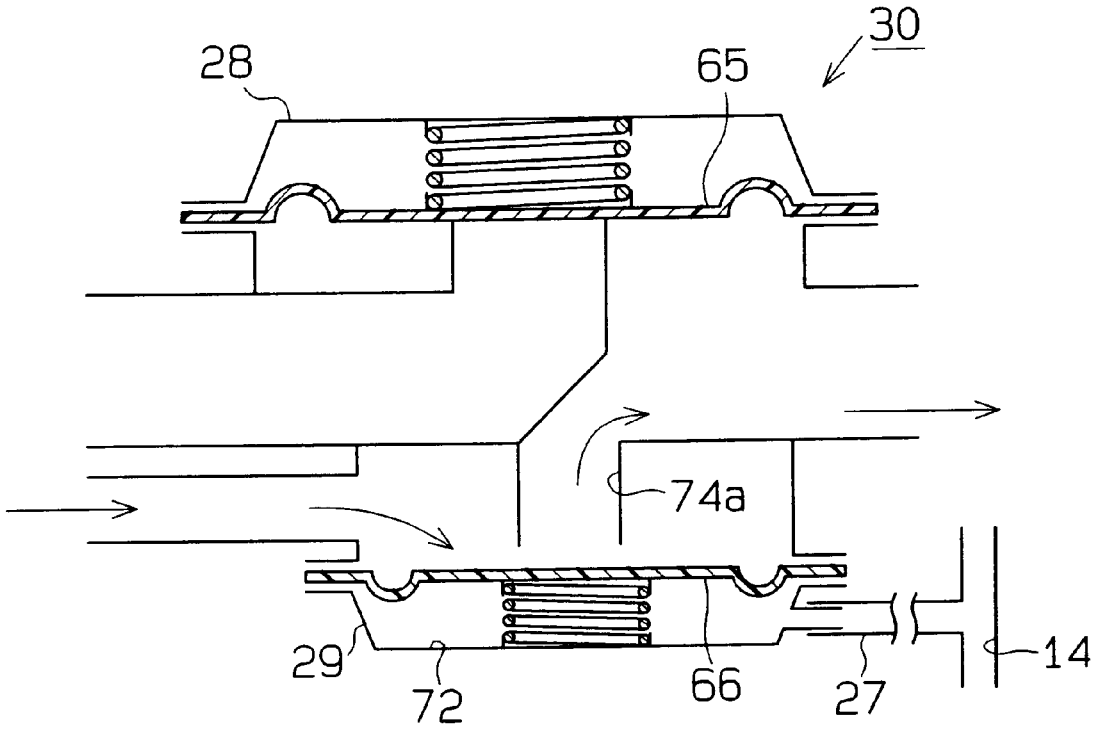
FIG. 6 is a schematic cross-sectional view showing the operation of an atmospheric valve device used in the canister.

The operation of the valve device 30 when performing purging will now be described with reference to FIGS. 5 and 6. As described above, when the fuel components in the canister 1 are sent to the engine intake system, the vacuum pressure of the intake system lowers the pressure in the canister 1 and opens the intake valve 29, as shown in FIG. 6. As a result, new ambient air is drawn into the positive pressure chamber 74 through the passage 74*a* and sent into the canister 1.

In the prior art canister shown in FIG. 9, the flow of air passing through the atmospheric valve may cause resonance and produce noise especially when the air flows at a constant and relatively low rate. More specifically, when the atmospheric valve is opened sightly, a whistling noise is produced when ambient air passes through the small opening of the atmospheric valve.

To solve this problem, in the canister 1 according to the present invention, the back pressure chamber 72 is directly connected with the purge passage 14 through the pressure passage 27. Therefore, the vacuum pressure corresponding to the opening and closing of the purge valve 16 produces pulsations, which have a relatively large amplitude and which acts on the diaphragm 66. The vacuum pressure forcibly vibrates the diaphragm vertically. Accordingly, slight vibrations of the diaphragm 66 are suppressed and the production of the noise is prevented.

It should be apparent to those skilled in the art that the present invention may be embodied in many other specific forms without departing from the spirit or scope of the invention. Particularly, it should be understood that the invention may be embodied in the following forms.

Partitions such as guide fins or baffles may be provided in the external dispersion compartment 62 to further effectively disperse the fuel vapor drawn into the external dispersion compartment 62 from the breather passage 12.

Figure 7:
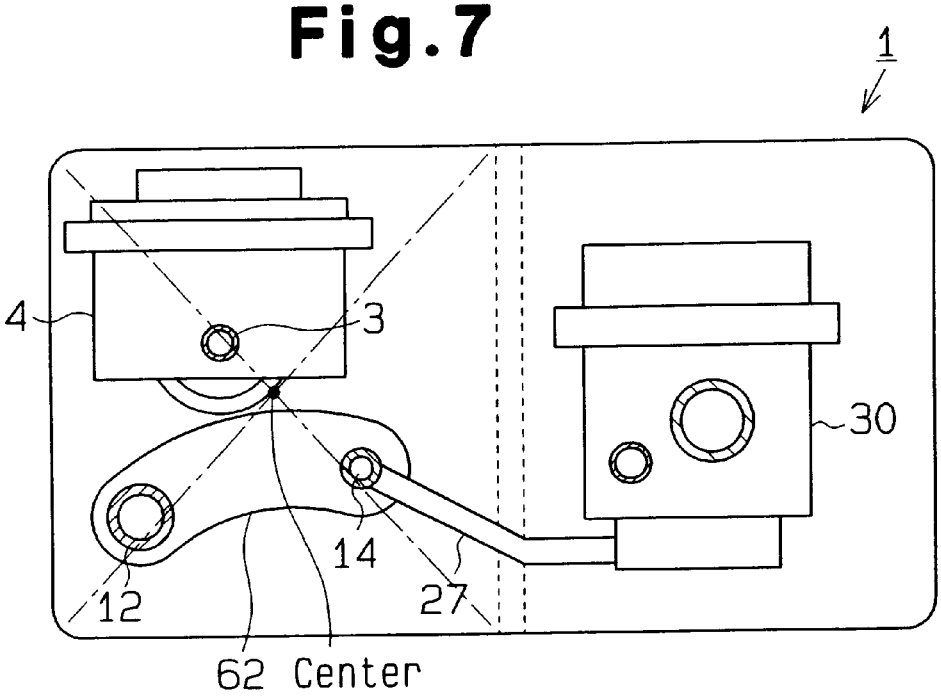
FIG. 7 is a cross-sectional side view showing a further embodiment of a canister according to the present invention.
Figure 8:
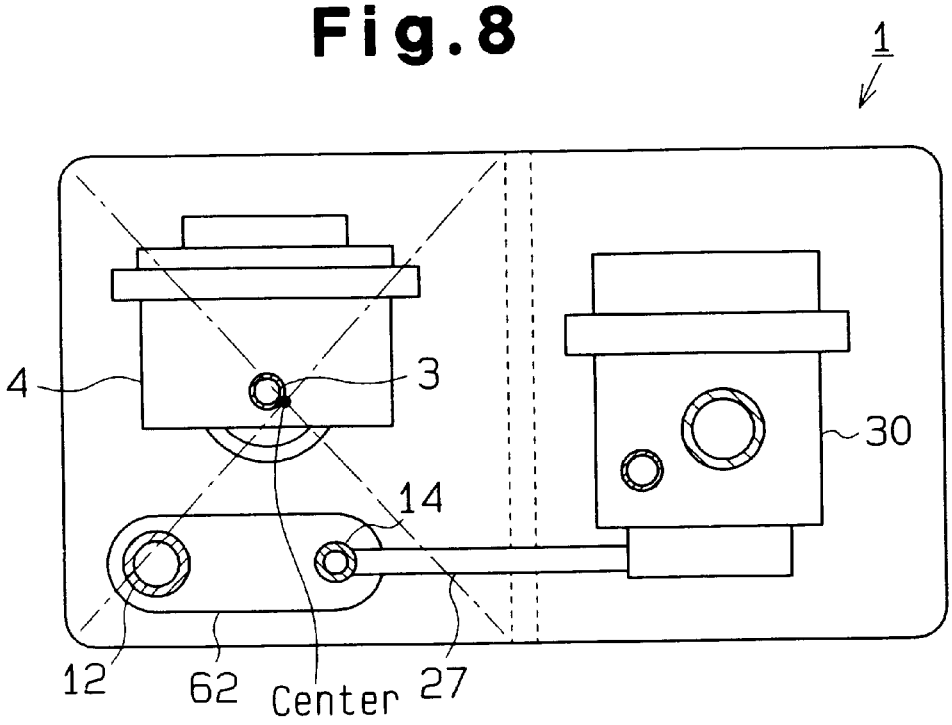
FIG. 8 is a cross-sectional side view showing a further embodiment of a canister according to the present invention.

In a further embodiment according to the present invention, the external dispersion compartment 62 may be located closer to the central portion, as shown in FIG. 7. On the other hand, the external dispersion compartment 62 may be separated from the central portion, as shown in FIG. 8. The dispersion effect of the fuel vapor is also obtained with these structures.

Instead of connecting the breather passage 12 and the purge passage 14 to the external dispersion compartment 62, the breather passage 12 may be connected to the external dispersion compartment 62, while the purge passage 14 is directly connected to the canister 1.

Three or more dispersion compartments communicated with one another may be provided in the canister 1 by dividing the external dispersion compartment or by adding other dispersion compartments. As another option, instead of providing a plurality of external dispersion compartments, the diameter of the opening between the breather passage 12 and the canister 1 may be enlarged to form a supplemental dispersion space for the fuel vapor drawn into the canister 1.

Instead of connecting the pressure passage 27 with the purge passage 14, the pressure passage 27 may be connected directly with the intake system such as the surge tank 15. In this case, a valve that is selectively opened and closed may be arranged in the pressure passage 27 to produce pulsations of the pressure communicated to the back pressure chamber 72.

The present invention may be applied to an up-down flow type canister, in which fuel vapor flow vertically. Furthermore, another dispersion compartment may be provided between the tank valve 4 and the canister 1.

Therefore, the present examples and embodiments are to be considered as illustrative and not restrictive and the invention is not to be limited to the details given herein, but may be modified within the scope and equivalence of the appended claims.

What is claimed is:

1. A canister for treating fuel vapor generated in a fuel tank and for supplying fuel vapor to an intake system of an engine via a purge passage, the canister comprising:

a casing;

an adsorbent compartment defined in the casing for accommodating adsorbent;

an internal dispersion compartment defined in the casing for dispersing fuel vapor introduced from the fuel tank, the internal dispersion compartment being located at one end of the adsorbent compartment;

an external dispersion compartment connected to a wall of the casing to communicate with the internal dispersion compartment; and a breather passage connected to the external dispersion compartment for introducing fuel vapor into the canister from the fuel tank during refueling, wherein the external compartment has a cross sectional area larger than that of the breather passage and communicates with the internal dispersion compartment via an opening that has a cross sectional area larger than that of the breather passage.

2. The canister according to claim 1, further comprising a vapor passage connected between the fuel tank and the external dispersion compartment for conducting fuel vapor from the fuel tank to the canister.

3. The canister according to claim 2, wherein the internal dispersion compartment is a first dispersion compartment, and the adsorbent compartment is a first adsorbent compartment, the canister further comprising:

a second adsorbent compartment, which is defined in the casing by a partition, for accommodating adsorbent; and a second dispersion compartment, which is defined in the casing, for dispersing fuel vapor introduced from the fuel tank.

4. The canister according to claim 3, further comprising a tank valve, which is connected to a wall of the casing that corresponds to the first adsorbent compartment, for adjusting the pressure in the fuel tank, wherein the external dispersion compartment is positioned on the same side of the casing as the tank valve without physically interfering with the tank valve.

5. The canister according to claim 4, wherein the external dispersion compartment is located at a position substantially corresponding to the center of the first dispersion compartment.

6. A canister for treating fuel vapor generated in a fuel tank and for supplying fuel vapor to an intake system of an engine via a purge passage, the canister comprising:

a casing;

a first adsorbent compartment defined in the casing by a partition for accommodating adsorbent;

a second adsorbent compartment defined in the casing by the partition for accommodating adsorbent;

a first dispersion compartment defined in the casing, the first dispersion compartment being located at one end of the first adsorbent compartment, for dispersing fuel vapor from the fuel tank;

a second dispersion compartment defined in the casing, the second dispersion compartment being located at one end of the second adsorbent compartment, for dispersing fuel vapor from the fuel tank;

a valve device positioned at one side of the second adsorbent compartment for selectively opening and closing in accordance with the difference between internal and external pressures of the casing;

a tank valve connected to one side of the casing corresponding to the first adsorbent compartment for adjusting the pressure in the fuel tank;

an external dispersion compartment connected to a wall of the casing to communicate with the first dispersion compartment; and a breather passage connected to the external dispersion compartment for introducing fuel vapor into the canister from the fuel tank during refueling, wherein the external dispersion compartment has a cross sectional area larger than that of the breather passage.

7. The canister according to claim 6, wherein the external dispersion compartment is positioned on the same side of the casing as the tank valve without physically interfering with the tank valve.

8. The canister according to claim 7, wherein the external dispersion compartment is located at a position substantially corresponding to the center of the first dispersion compartment.

9. The canister according to claim 8, wherein the purge passage is connected to the external dispersion compartment.

10. The canister according to claim 6, further comprising a vapor passage connected between the fuel tank and the tank valve for introducing fuel vapor from the fuel tank into the canister.

11. The canister according to claim 10, wherein the tank valve opens to introduce fuel vapor into the canister when the pressure in the fuel tank is greater than a predetermined pressure.

12. The canister according to claim 6, wherein the valve device includes an intake valve having a diaphragm therein for introducing external air into the casing, and wherein the intake valve opens when the pressure in the casing is less than the ambient pressure by a predetermined amount.

13. The canister according to claim 12, further comprising a pressure passage connected between the purge passage and the intake valve for supplying a vacuum pressure pulsation generated in the intake system to vibrate diaphragm.

14. The canister according to claim 13, wherein the valve device further includes a relief valve having a diaphragm therein for releasing gas in the casing, and wherein the relief valve opens when the pressure in the casing is greater than the ambient pressure of the casing by a predetermined amount.

* * * * *